US006394828B1

(12) United States Patent
Kodama et al.

(10) Patent No.: US 6,394,828 B1
(45) Date of Patent: May 28, 2002

(54) CARD CONNECTOR EQUIPPED WITH MEANS FOR PREVENTING UNDESIRED CARD REMOVAL

(75) Inventors: Takao Kodama, Machida; Takao Ito, Yokosuka; Shiniichi Maezono, Ebina; Masahiro Mogi, Yokohama, all of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/911,666

(22) Filed: Jul. 24, 2001

(51) Int. Cl.[7] ..... H01R 13/62
(52) U.S. Cl. ..... 439/159
(58) Field of Search ..... 439/159, 160, 439/152

(56) References Cited

U.S. PATENT DOCUMENTS

| | | | | |
|---|---|---|---|---|
| 6,129,572 A | | 10/2000 | Feldman et al. | 439/328 |
| 6,132,248 A | | 10/2000 | Ramey | 439/570 |
| 6,155,853 A | * | 12/2000 | Kajiura | 439/159 |
| 6,174,180 B1 | | 1/2001 | Chen | 439/159 |
| 6,176,714 B1 | | 1/2001 | Ishida et al. | 439/159 |

* cited by examiner

*Primary Examiner*—P. Austin Bradley
*Assistant Examiner*—Ross Gushi
(74) *Attorney, Agent, or Firm*—Stacey E. Caldwell

(57) ABSTRACT

Disclosed is a card connector equipped with an eject mechanism that includes a rotary lever and an ejection rod with a catch tab formed thereon for preventing the card from being inadvertently removed or disengaged from the connector particularly in high vibration environments. The card connector includes an insulating housing having two parallel longitudinal extensions extending from lateral sides of the housing. One longitudinal extension has a support frame fixed to its outer side for accommodating movably the ejection rod. The support frame has two guide projections formed thereon, and the ejection rod has a corresponding guide slot within which the guide projections are received. The two guide projections are staggered that one may be close to the longitudinal extension, and that the other may be apart from the longitudinal extension whereas the guide slot has an intermediate oblique section between the leading and trailing straight sections. With this arrangement the ejection rod can move between a parallel position and an angled position whereat it is tilted close to the opening of the card cavity. The angled position of the ejection rod allows the catch tab to block the card cavity and prevent the card from being inadvertently removed or disengaged from the card connector.

5 Claims, 10 Drawing Sheets

CARD CONNECTOR EQUIPPED WITH MEANS FOR PREVENTING UNDESIRED CARD REMOVAL

FIELD OF THE INVENTION

The present invention relates to a card connector for connecting a card such as a flash memory card to a printed circuit board, and specifically to such a card connector equipped with an ejector mechanism including a catch tab formed thereon for preventing the card from being inadvertently removed from the connector.

BACKGROUND OF THE INVENTION

Known card connectors typically comprise an insulating housing having a plurality of terminals laterally arranged and mounted therein and adapted to mate with corresponding contacts on a memory card, and a card ejector mechanism for ejecting the card from the housing. The card ejector mechanism is composed of a rotary lever pivotally fixed to the housing and an ejection rod operatively connected to the rotary lever for turning the rotary lever and ejecting the card.

The rotary lever is pivotably movable relative to the housing and is mounted between the housing and an overlying shell cover. The ejection rod is movably mounted on one side of the housing, such that it moves back and forth in directions opposite to the directions in which the card is ejected and inserted into the housing. One end of the ejection rod is operatively connected to one end of the rotary lever. The rotary lever has a tab provided on the other end, and the tab of the rotary lever engages the front end of the card after it is fully inserted into the housing. With this arrangement, insertion of the card into the card connector causes the rotary lever to turn in one direction, thus causing the ejection rod to move in the (rearward) direction opposite the (forward) direction in which the card is inserted. Conversely, when the ejection rod is pushed inward, i.e. in the forward direction, the rotary lever turns in the opposite direction, thus causing the tab to eject the card from the housing.

When the card is inserted into the card cavity, the card is held within the cavity and prevented from being removed from the card cavity by forces generated by the coupling of the pin terminals of the connector with female contacts of the card. However, some card connectors are used in electronic devices such as car navigators or car radios, which may be subjected to constant vibration. In such circumstances, the connection between the card and the connector can be loosened or broken altogether, thus impairing the reliability between the card and its associated printed circuit board via the card connector. Therefore, in such cases, the card can fall out and be damaged or be much too easily (inadvertently) removed from the card connector.

SUMMARY OF THE INVENTION

An object of the present invention is to provide a card connector structure which can hold a card within the card connector when it is inserted in the card cavity of the card connector.

To attain this object, the card connector according to the present invention includes an ejection mechanism having a rotary lever and an ejection rod equipped with a catch tab and designed such that the ejection rod is angled toward the card cavity of the card connector when it moves rearward in response to insertion of the card into the card cavity, thereby allowing the tilted ejection rod to catch the card by the catch tab.

Specifically, the card connector for receiving a memory card comprises: a U-shaped insulating housing having a main body and two parallel longitudinal extensions connected to and extending from opposite ends of the main body and defining a card cavity therebetween, one of the longitudinal extensions including a support frame fixed to an outer side thereof; a plurality of terminals mounted in the main body and adapted to mate with corresponding contacts in the memory card; and a card ejector mechanism for ejecting the card from the card cavity, including a rotary lever pivotably mounted on the housing for pivotal movement relative thereto and an ejection rod for turning the rotary lever mounted along the one longitudinal extensions for back and forth movement within the support frame in directions opposite and parallel to the insertion and ejection directions of the card, wherein the card connector further comprises corresponding interengaging means including a guide slot (27) and corresponding guide projections (23, 24) between the ejection rod and the support frame such that as the ejection rod moves back and forth within the support frame, the ejection rod moves between an angled position and a parallel position, whereby in the angled position, the ejection rod prevents the inserted card from being inadvertently removed. The ejection rod includes an integral catch tab facing the card cavity, whereby the catch tab prevents the card from being removed when the ejection rod is in its angled position, i.e. tilted toward the card cavity, and whereby the catch tab releases the card when the ejection rod moves away from the card cavity.

The guide slot is composed of a straight leading section, an intermediate oblique section and a straight trailing section, and the support frame has two guide projections formed therein which move within the guide slot.

The ejection rod includes a joint formed at a front end connected to the rotary lever, and a knob formed at its rear end, wherein the catch tab extends from the knob and catches the rear edge of the card after the card is inserted in the card cavity and prevents the card from disengaging or being inadvertently removed from the card cavity.

Other objects and advantages of the present invention will be understood from the following description of a card connector according to a preferred embodiment of the present invention in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DESCRIPTION OF THE PREFERRED EMBODIMENTS

Figure 5:
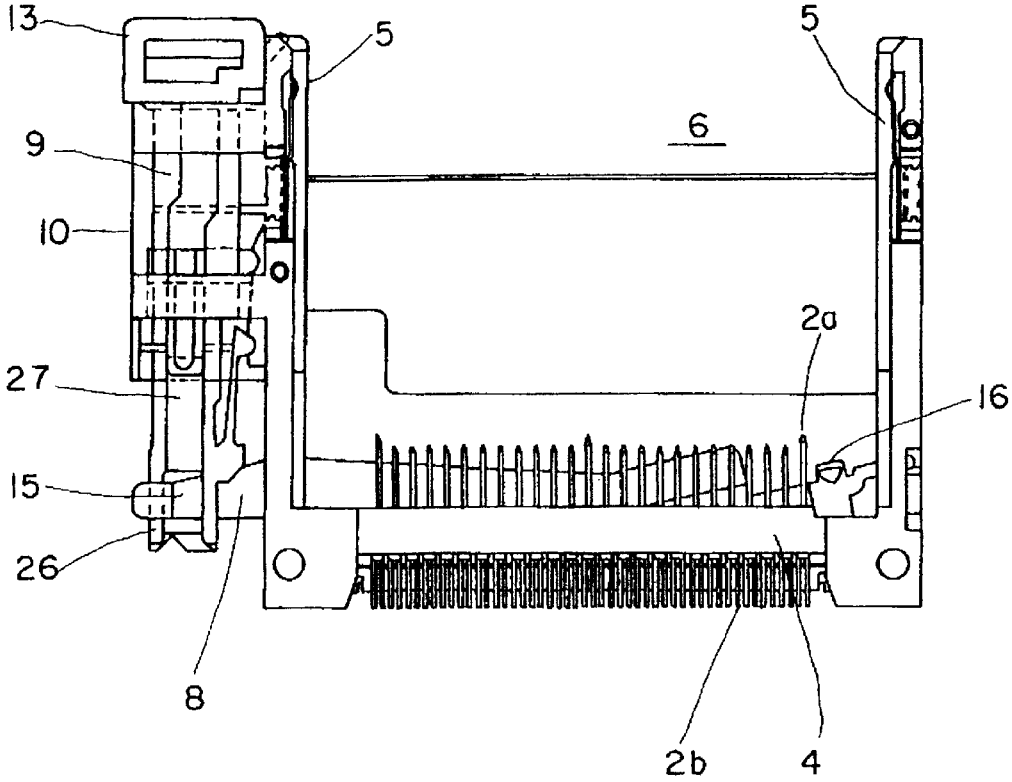
FIG. 5 is a bottom view of the card connector.
Figure 6:
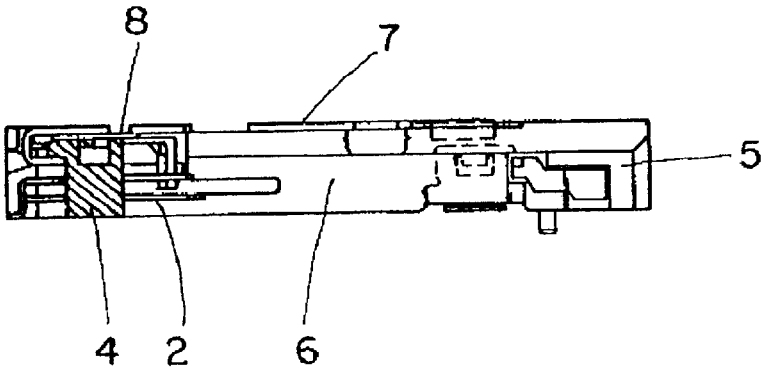
FIG. 6 is a sectional view of the card connector taken along the line A—A in FIG. 1.
Figure 7:
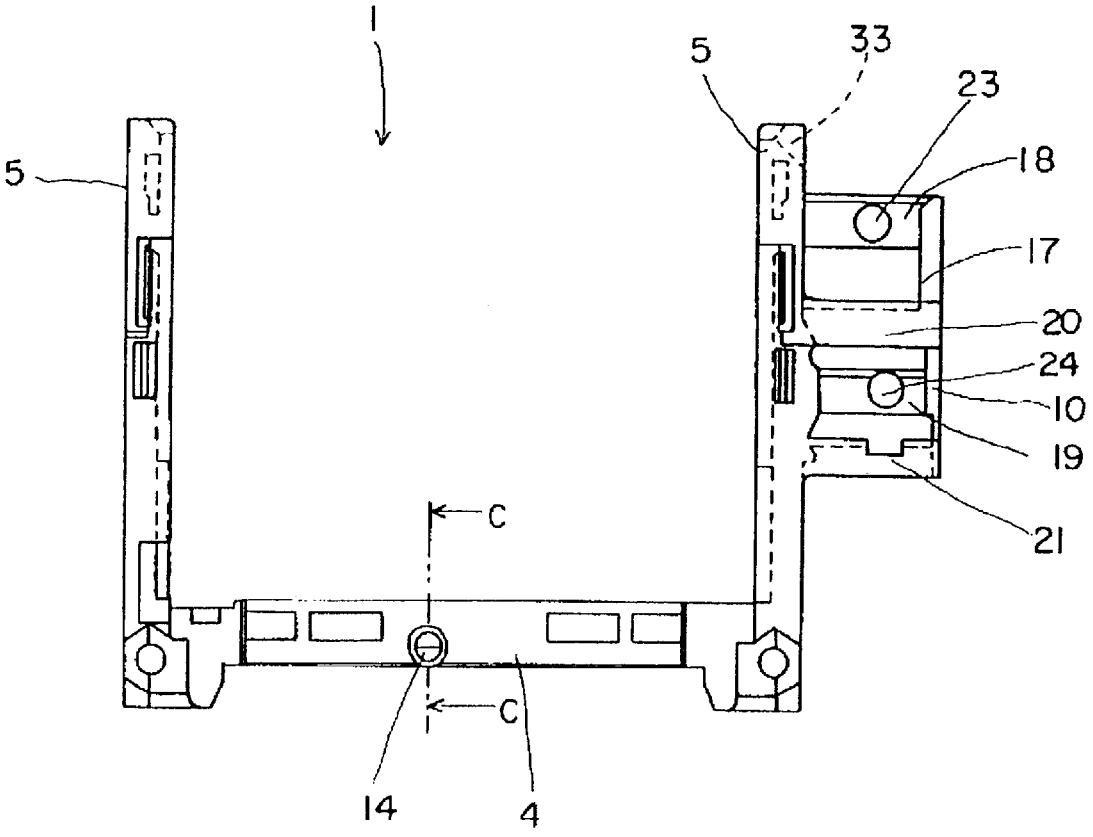
FIG. 7 is a plan view of the insulating housing of the card connector according to the present invention.
Figure 8:
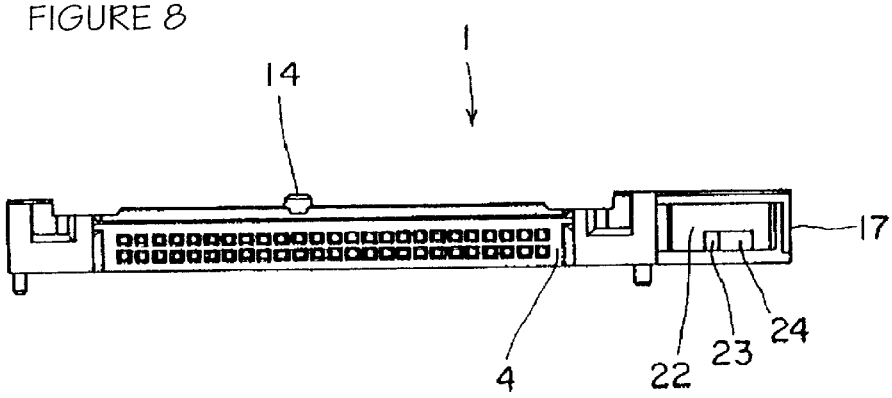
FIG. 8 is a front view of the insulating housing.

A card connector according to the present invention is described below. Referring first to FIGS. 1 through 6, the card connector of the present invention comprises a U-shaped insulating housing 1, upper and lower arrangements of terminals 2 mounted in housing 1, and a card ejector 3 for ejecting a card, such as a flash memory card, from the card connector. Insulating housing 1 is made of plastic material and comprises an elongated main body 4 and two parallel longitudinal extensions 5 integrally connected to and extending from opposite ends of main body 4, as seen in FIGS. 5 and 7. A card cavity 6 is defined by the area between longitudinal extensions 5.

Each terminal 2 is stamped and formed from sheet metal material and is fixed to main body 4 so that a pin contact 2*a* extends into card cavity 6 for mating to a corresponding female contact on the front side of the inserted card, and a dependent solder tail 2*b* is flush with the bottom of insulating housing 1, to enable soldering of the solder tails to corresponding conductors of an underlying printed circuit board.

Figure 9:
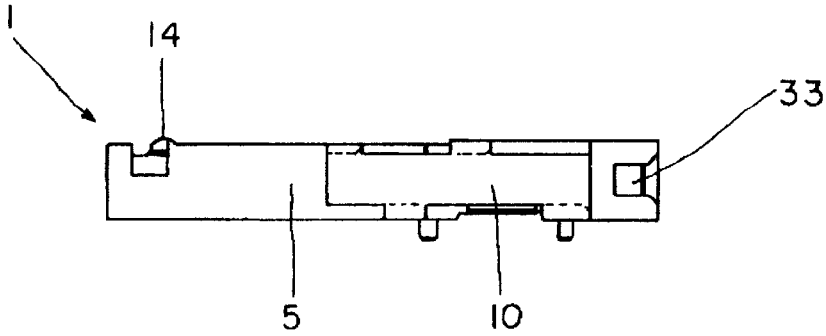
FIG. 9 is a right side view of the insulating housing.
Figure 10:
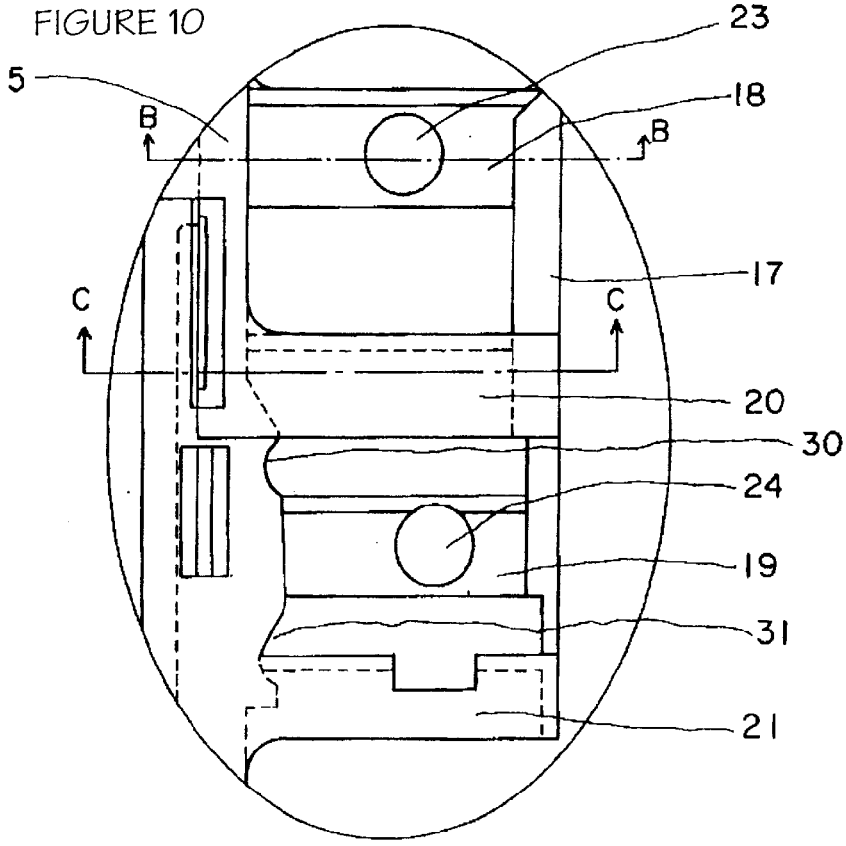
FIG. 10 is an enlarged plan view of the support frame of the insulating housing.
Figure 11:
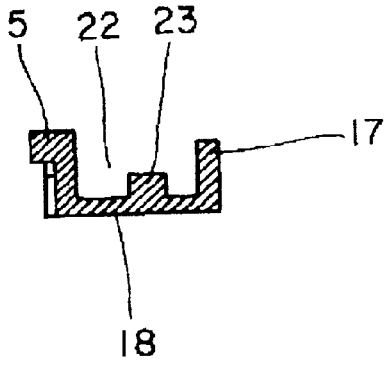
FIG. 11 is a sectional view of the insulating housing taken along the line B—B in FIG. 10.
Figure 12:
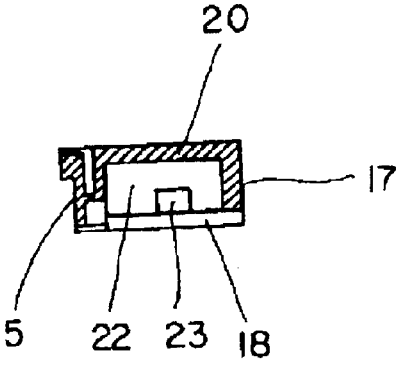
FIG. 12 is a sectional view of the insulating housing taken along the line C—C in FIG. 10.

A rectangular shell cover 7 extends between longitudinal extensions 5, thereby partially covering card cavity 6 and at the same time reinforcing the longitudinal extensions 5. Shell cover 7 is stamped out of a relatively thin sheet metal material, and each longitudinal extension 5 is notched to a depth equal to the thickness of the cover on its inner side (see FIG. 9), thus allowing opposite ends of shell cover 7 to fit in the notch of each longitudinal extension 5 such that the upper surface of shell cover 7 is generally flush with the upper surface of a cover member of an inserted card (not shown).

Card ejector 3 comprises a rotary lever 8 and an ejection rod 9 for turning rotary lever 8. Ejection rod 9 is fabricated of plastic material and is mounted within an associated support frame 10 formed on one of the longitudinal extensions 5. Ejection rod 9 can move back and forth within support frame 10 along the one longitudinal extension 5. A knob 13 is formed on the end of ejection rod 9.

Rotary lever 8 is rotatably mounted on main body 4 of insulating housing 1 so that it turns about a round stud 14 formed on the middle of the main body. Rotary lever 8 has a joint 15 formed on one end thereof and a dependent tab 16 formed on the other end. Joint 15 of rotary lever 8 is connected to one end of ejection rod 9. When ejection rod 9 moves back and forth within support frame 10, as indicated by arrows 12 and 11 in FIG. 1, rotary lever 8 turns accordingly.

Insertion of a card into card cavity 6 of insulating housing 1 puts the front of the card in engagement with dependent tab 16, thereby causing rotary lever 8 to turn counter clockwise to move ejection rod 9 rearwardly, thus causing knob 13 of ejection rod 9 to project outwardly. When ejection rod 9 is moved forward by pushing knob 13 (as indicated by arrow 11), rotary lever 8 turns clockwise and the card is pushed out of the card cavity. The positions of rotary lever 8 and ejection rod 9 after pushing knob 13 are shown in solid lines in FIG. 1, whereas the positions of the rotary lever and ejection rod after inserting a card in card cavity 6 are shown in broken lines in FIG. 1. The arrangement described so far is found in a conventional card connector structure. The feature of the present invention resides in the structure of ejection rod 9 and associated support frame 10 and will be described hereinafter.

As described below in detail, ejection rod 9 can change its relative position from a parallel position whereat it extends parallel to the longitudinal extensions of the insulating housing to an angled position whereat it is no longer parallel to the longitudinal extensions and its knob is moved toward card cavity 6 as ejection rod 9 moves rearward in support frame 10, and ejection rod 9 can change its relative position from the angled position back to the parallel position as ejection rod 9 moves forward in support frame 10. The structure which allows this to happen is described below.

FIGS. 7 to 12 show insulating housing 1. Support frame 10 is integrally connected to the right (as shown in the drawings) longitudinal extension 5 of housing 1. Specifically a longitudinal side wall 17 extends parallel to right longitudinal extension 5, and lower and upper cross-plates 18, 19 and 20, 21 traverse between longitudinal extension 5 and longitudinal side wall 17 like a ladder. These lower and upper cross-plates are staggered as viewed from the top, and a rod-insertion passage 22 extends from the front to rear to receive ejection rod 9.

Lower cross-plate 18 has an upright round guide projection 23 at its center, extending upward into insertion passage 22. Likewise, cross-plate 19 has an upright round guide projection 24 positioned slightly closer to longitudinal side wall 17, extending upward into insertion passage 22, as seen in FIG. 7.

Figure 19:
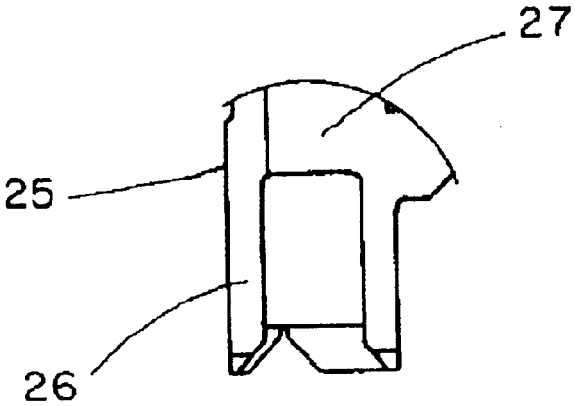
FIG. 19 is an enlarged view of the encircled part F in FIG. 15.

Referring to FIGS. 13 to 19, ejection rod 9 is molded of an insulating plastic mold and includes a shank 25 having a knob 13 formed at one end, and a joint 26 formed on the other. As seen in FIG. 19, joint 26 of ejection rod 9 is connected to counter joint 15 of rotary lever 8. Shank 25 of ejection rod 9 has a slot 27 formed on its bottom, such that it has a U-shaped cross section. When ejection rod 9 is inserted in support frame 10, slot 27 accommodates round guide projections 23 and 24 of lower cross-plates 18 and 19.

Figure 15:
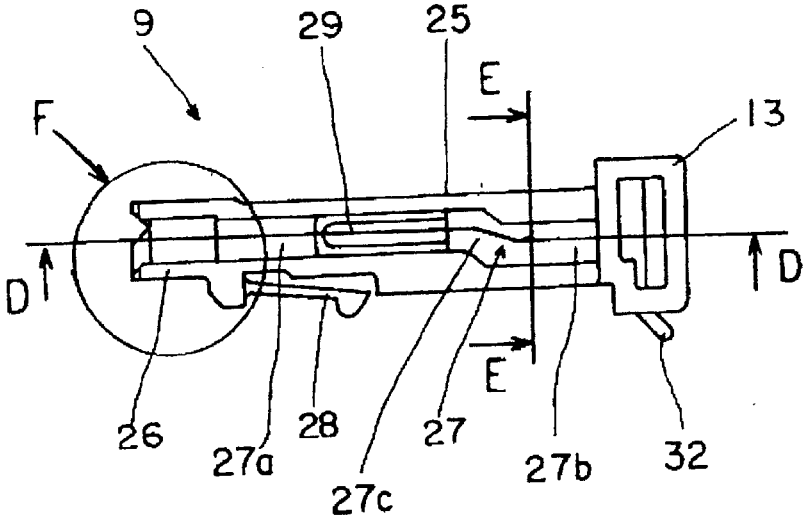
FIG. 15 is a bottom view of the ejection rod.
Figure 16:
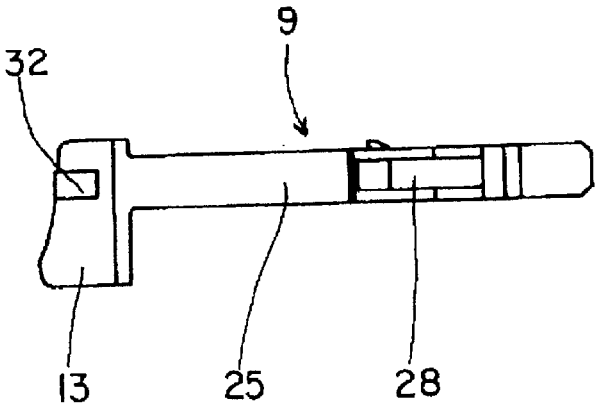
FIG. 16 is a rear view of the ejection rod.

Shank 25 of ejection rod 9 is straight, but slot 27 is angled as best seen in FIG. 15. Specifically, slot 27 is composed of a straight leading section 27*a* slightly closer to the outer edge of shank 25, an intermediate oblique section 27*c* contiguous with straight leading section 27*a*, and a straight trailing section 27*b* slightly closer to the inner edge of shank 25, which trailing section 27*b* is contiguous with intermediate oblique section 27*c*. The outward deviation of straight leading section 27*a* aligns guide projection 24 of lower cross-plate 19 whereas the inward deviation of straight trailing section 27*b* aligns guide projection 23 of lower cross-plate 18.

Figure 13:
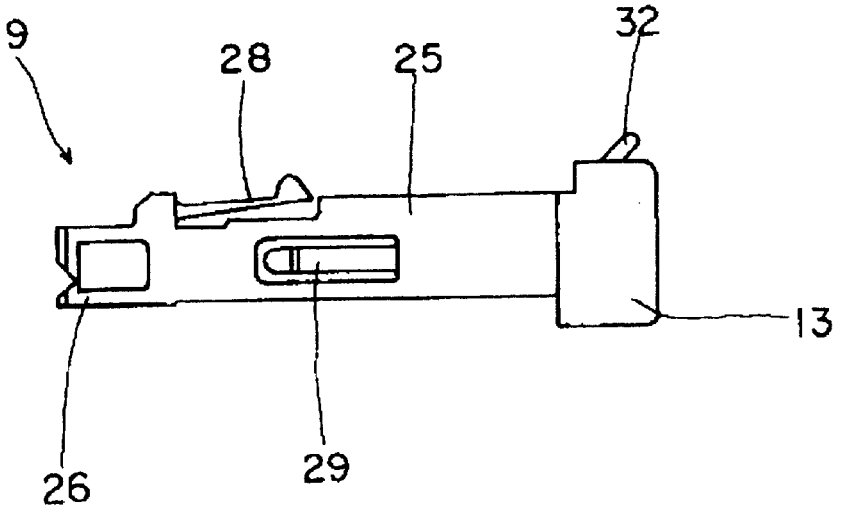
FIG. 13 is a plan view of the ejection rod of the card connector according to the present invention.
Figure 17:
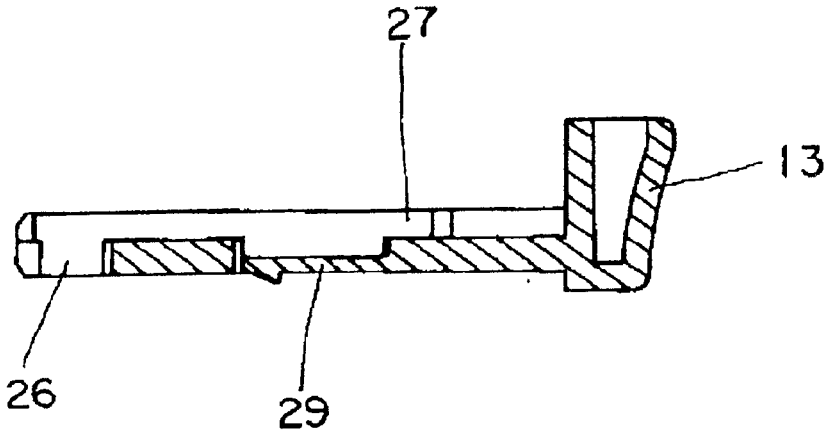
FIG. 17 is a sectional view of the ejection rod taken along the line D—D in FIG. 15.
Figure 18:
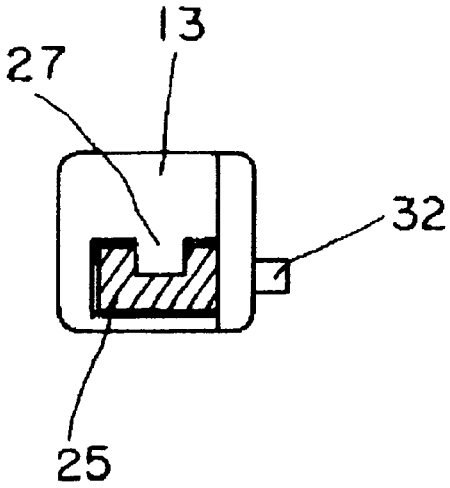
FIG. 18 is a sectional view of the ejection rod taken along the line E—E in FIG. 15.

As seen in FIGS. 13, 15 and 17, shank 25 has two latch pieces 28 and 29 integrally connected thereto. Specifically, when ejection rod 9 is inserted in support frame 10, latch piece 28 faces longitudinal extension 5 of insulating housing 1 whereas latch piece 29 confronts upper cross-plates 20 and 21 of support frame 10. When ejection rod 9 moves back and forth, latch piece 28 falls in recesses 30 and 31 (see FIG. 10) made on right longitudinal extension 5, thus providing an audible "click" at selected positions. Latch piece 29 provides a stopper in cooperation with upper cross-plates 20 and 21 for limiting the range of motion of ejection rod 9.

Figure 1:
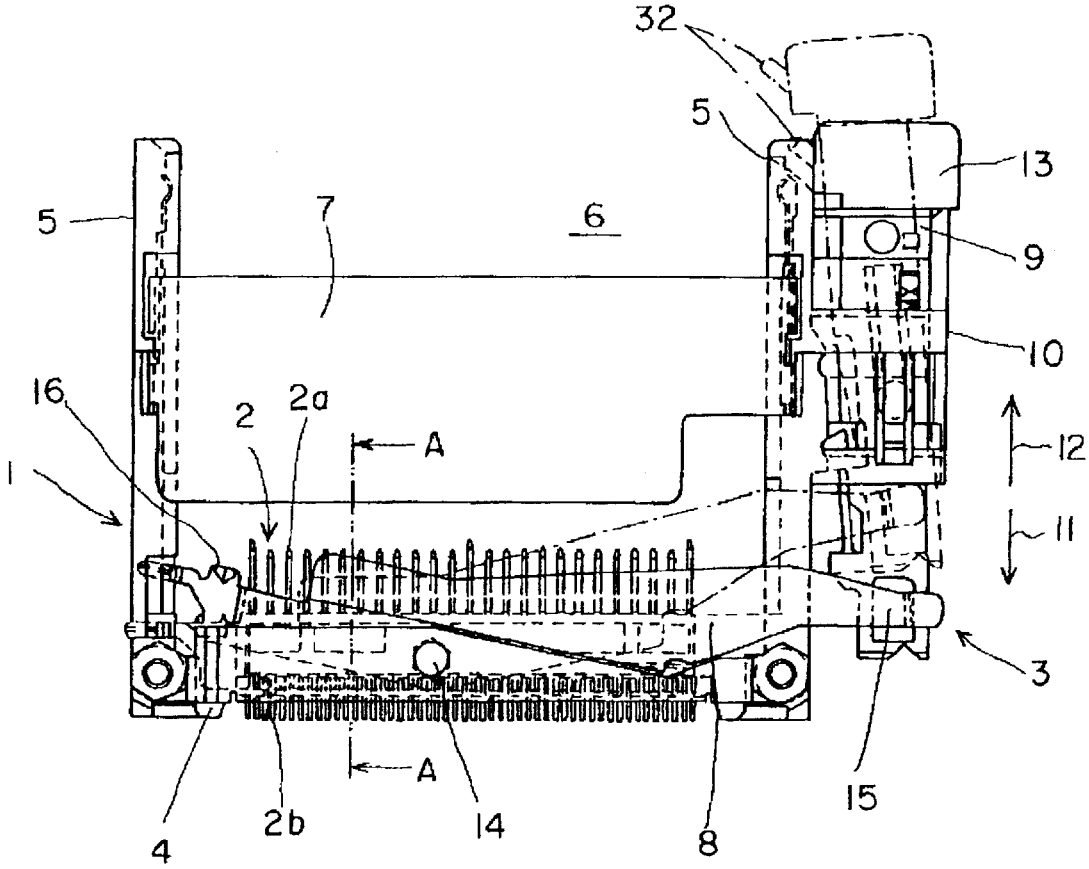
FIG. 1 is a plan view of a card connector according to the present invention.
Figure 2:
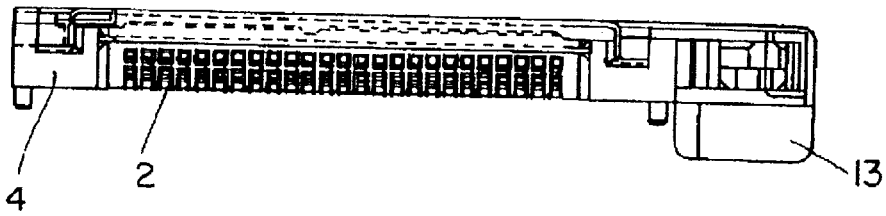
FIG. 2 is a front view of the card connector.
Figure 3:
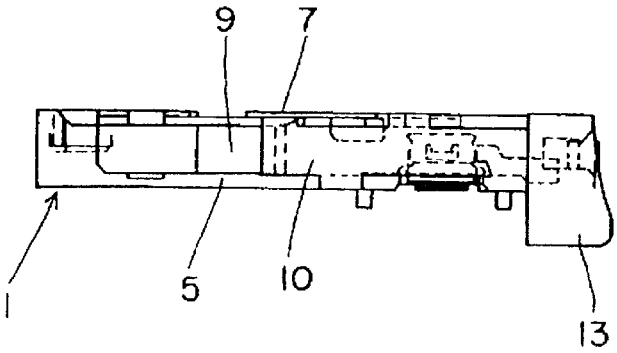
FIG. 3 is a right side view of the card connector.
Figure 4:
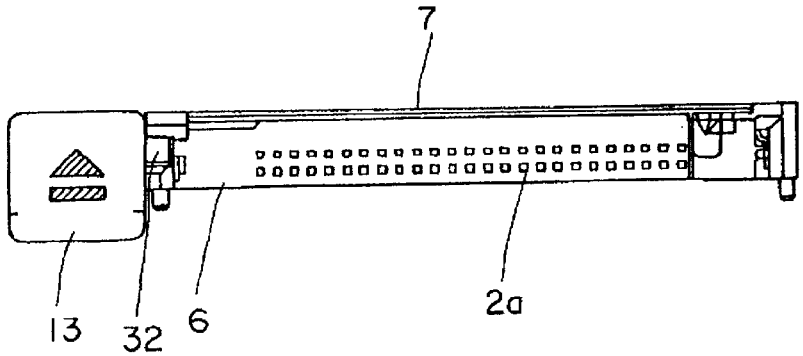
FIG. 4 is a rear view of the card connector.
Figure 14:
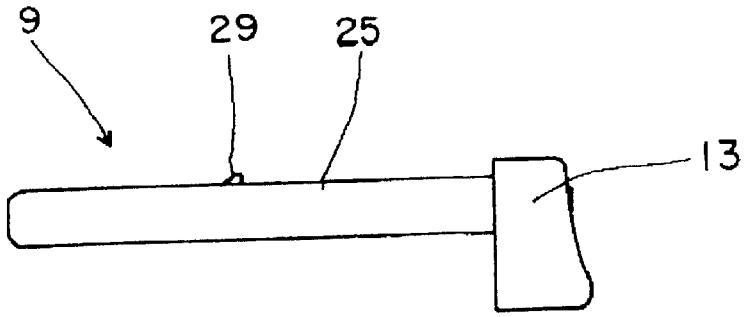
FIG. 14 is a front view of the ejection rod.

As seen in FIGS. 1, 13 and 14, knob 13 of ejection rod 9 has an oblique catch tab 32 integrally connected to an inner surface thereof. As described above, knob 13 is closer to right longitudinal extension 5 when ejection rod 9 is pushed in, as shown in solid lines in FIG. 1. Right longitudinal extension 5 has a notch 33 made at its outer corner for accommodating catch tab 32 (see FIG. 9).

Ejection rod 9 is inserted in the insertion passage of support frame 10 with guide projections 23 and 24 movable accommodated within guide slot 27 of shank 25, and with joint piece 15 of rotary lever 8 coupled with joint 26 of shank 25.

Figure 20:
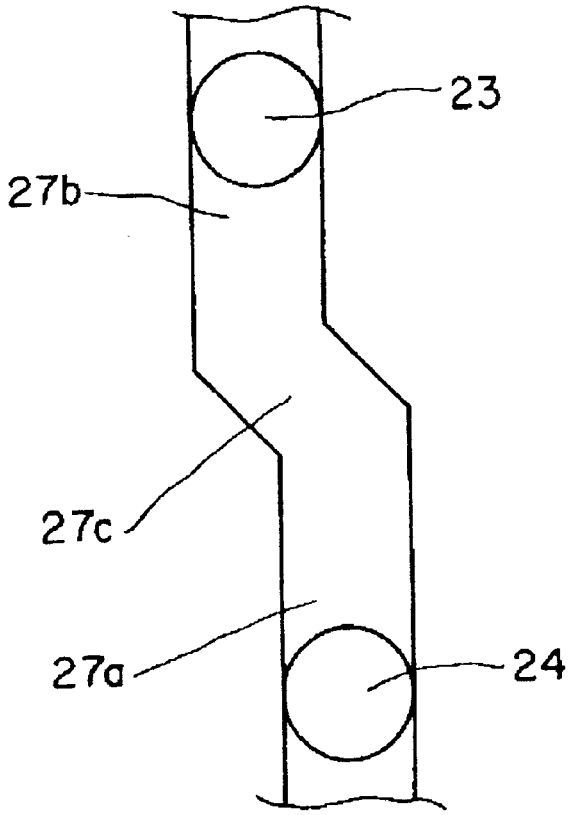
FIG. 20 illustrates how the ejection rod is tilted prior to insertion of a card.
Figure 20:
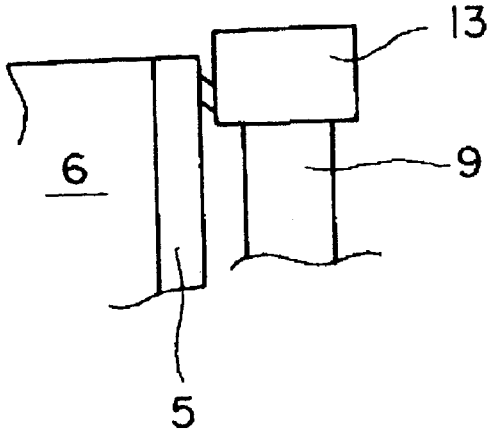
Figure 21:
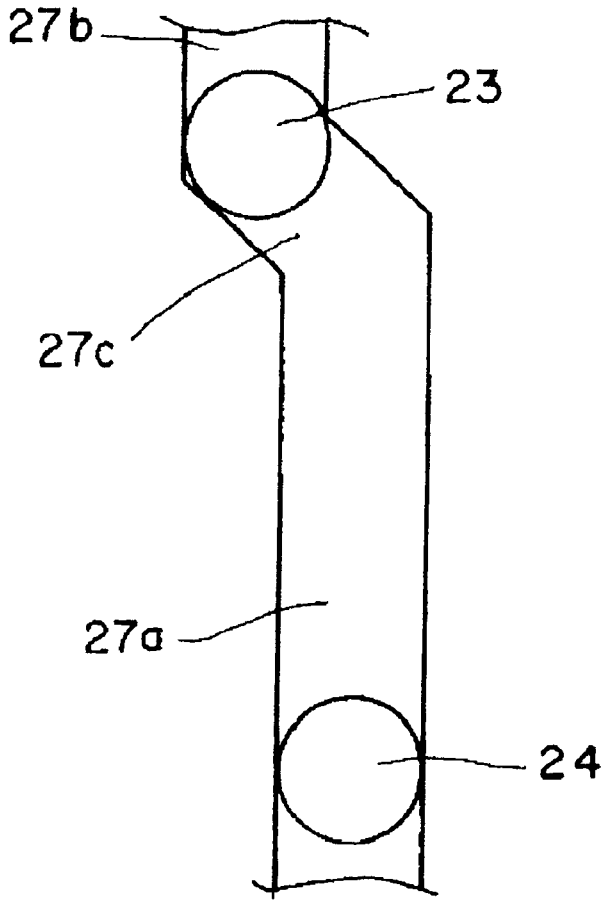
FIG. 21 illustrates how the ejection rod is tilted during insertion of the card.
Figure 21:
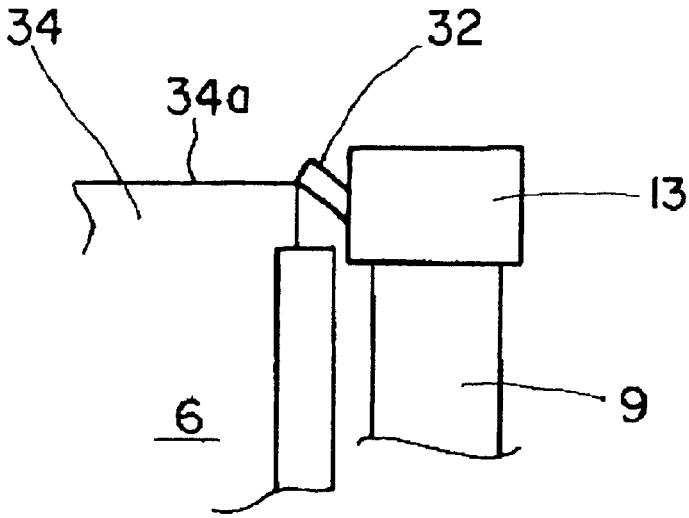
Figure 22:
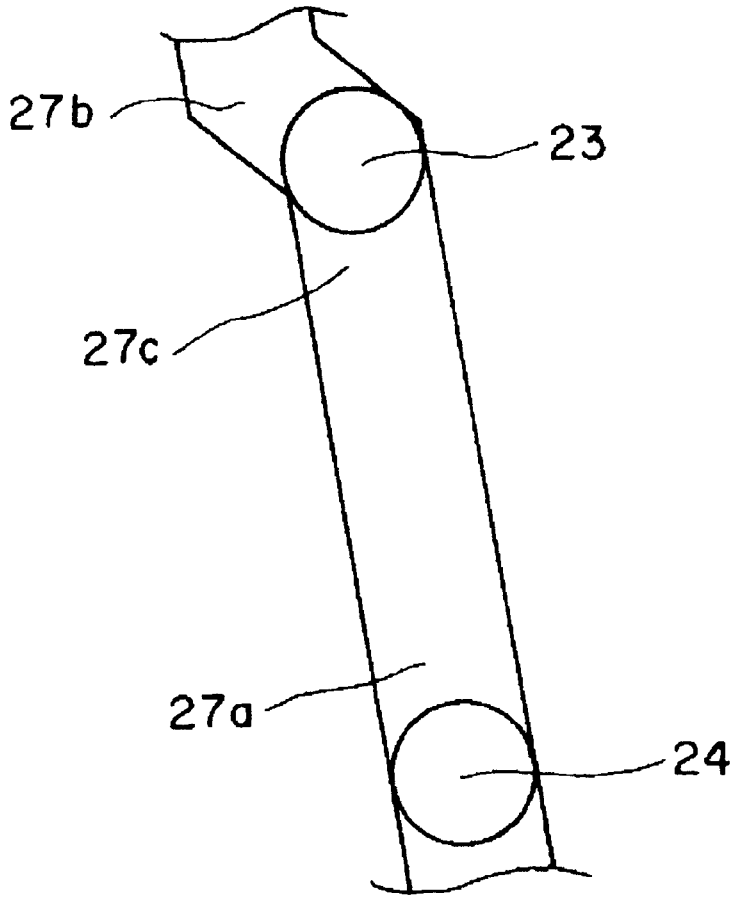
FIG. 22 illustrates how the ejection rod is tilted when the card is inserted completely.
Figure 22:
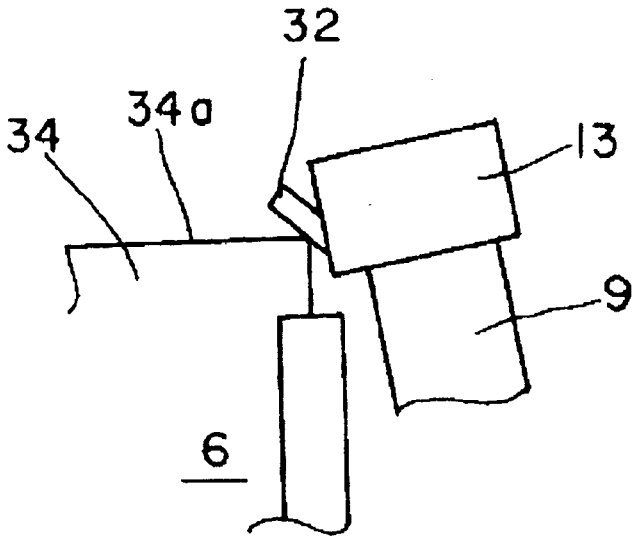

The movement of guide projections 23 and 24 within guide slot 27 provide the tilting means which allow ejection rod 9 to move between its angled and parallel positions. Referring to FIGS. 20 to 22, the movement of ejection rod 9 is described. FIG. 20 shows in which sections of slot 27 of shank 25 guide projections 23 and 24 are positioned prior to insertion of a card into card cavity 6. That is, guide projection 23 is positioned in trailing section 27*b* of guide slot 27, whereas guide projection 24 is in leading section 27*a* of guide slot 27. Thus, ejection rod 9 lies parallel to right extension 5 of housing 1, allowing catch tab 32 to be fit within notch 33 of longitudinal extension 5.

Insertion of the card into card cavity 6 causes rotary lever 8 to turn counter-clockwise, so that ejection rod 9 moves backward (as indicated by arrow 12 in FIG. 1). Referring to FIG. 21, first, ejection rod 9 moves back along longitudinal extension 5 so that intermediate oblique section 27*c* reaches guide projection 23. The rear corner of a card 34 inserted in card cavity 6 appears in FIG. 21.

Ejection rod 9 continues to move back while being guided as guide projection 23 follows intermediate oblique section 27*c*, and guide projection 24 remains in leading section 27*a*, as seen in FIG. 22. Thus, ejection rod 9 is now in its angled position whereat knob 13 is close to card cavity 6, causing catch tab 32 to moved into the opening of card cavity 6.

Insertion of card 34 into card cavity 6 causes ejection rod 9 to move backward into the latching position in which catch tab 32 catches the corner of card 34, thereby preventing card 34 from disengaging or being inadvertently removed from card cavity 6. Thus, even though the card connector may be used in a constant vibration environment, the card-to-connector connection can be assured, and the risk of the card being inadvertently removed from the card cavity is minimized.

When card 34 is removed from card cavity 6 of the connector, ejection rod 9 is pushed in the direction indicated by arrow 11 in FIG. 1, thereby allowing guide projections 23 and 24 to follow guide slot 27 from the position of FIG. 22 to the position of FIG. 20 via the position of FIG. 21. Catch tab 32 is displaced from in front of the card opening (i.e. rightward in FIG. 1), thus permitting card 34 to be removed from card cavity 6 without resistance.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A card connector for receiving a memory card comprising:

a U-shaped insulating housing having a main body (4) and two parallel longitudinal extensions (5) connected to and extending from opposite ends of the main body and defining a card cavity (6) therebetween, one of the longitudinal extensions including a support frame fixed to an outer side thereof;

a plurality of terminals (2) mounted in the main body and adapted to mate with corresponding contacts in the memory card; and a card ejector mechanism (3) for ejecting the card from the card cavity (6), including a rotary lever (8) pivotably mounted on the housing for pivotal movement relative thereto and an ejection rod (9) for turning the rotary lever mounted along the one longitudinal extensions (5) for back and forth movement within the support frame in directions opposite and parallel to the insertion and ejection directions of the card, wherein the card connector further comprises corresponding interengaging means including a guide slot (27) and corresponding guide projections (23, 24) between the ejection rod and the support frame such that as the ejection rod moves back and forth within the support frame, the ejection rod moves between an angled position and a parallel position, whereby in the angled position, the ejection rod prevents the inserted card from being inadvertently removed.

2. A card connector according to claim 1 wherein the ejection rod (9) includes a catch tab (32) at an end thereof for engaging an end of an inserted card when the ejection rod is in its angled position.

3. A card connector according to claim 1 wherein the guide slot is formed in the ejection rod (9) and includes a straight leading section (27*a*), an intermediate oblique section (27*c*) contiguous with the straight leading section, and a straight trailing section (27*b*) contiguous with the intermediate oblique section.

4. A card connector according to claim 3 wherein the guide projections (23,24) are formed in the support frame (10) and are staggered relative to each other and to the longitudinal direction of the support frame.

5. A card connector according to claim 1 wherein when the ejection rod is in its angled position, the catch tab extends into the card cavity to contact and hold the card therewithin, and when the ejection rod is in its parallel position, the catch tab is located outside of the card cavity and allows the card to be removed therefrom.

* * * * *